US006769456B2

(12) United States Patent
Debaes et al.

(10) Patent No.: US 6,769,456 B2
(45) Date of Patent: Aug. 3, 2004

(54) DEVICE FOR SEPARATING WARP YARNS ON A FACE-TO-FACE WEAVING MACHINE

(75) Inventors: Johnny Debaes, Moorslede (BE); Dominique Maes, Wakken (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 277 days.

(21) Appl. No.: 10/126,955

(22) Filed: Apr. 22, 2002

(65) Prior Publication Data

US 2002/0166596 A1 Nov. 14, 2002

(30) Foreign Application Priority Data

Apr. 20, 2001 (BE) ..... 2001/0266

(51) Int. Cl.[7] ..... D03D 39/16

(52) U.S. Cl. ..... 139/21; 139/43; 139/37; 139/97

(58) Field of Search ..... 139/20, 21, 35, 139/55.1, 48, 98, 37, 114; 19/48

(56) References Cited

U.S. PATENT DOCUMENTS 2,460,512 A * 2/1949 Lanz ..... 139/24
2,649,864 A * 8/1953 Mayer, Jr. et al. ..... 139/97
3,394,739 A * 7/1968 Crenshaw et al. ..... 139/21
3,500,874 A * 3/1970 Golobart ..... 139/102
4,765,041 A * 8/1988 Baltzer ..... 28/191
5,615,712 A * 4/1997 Derudder et al. ..... 139/21

FOREIGN PATENT DOCUMENTS

EP 671 494 A 9/1995

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A device for separating warp yarns (16), (17) on a face-to-face weaving machine (13), comprising a separating means (1), (2) and a holding device (3,7,9,11), (4,8,9,12) which comprises a threaded adjusting means (11), (12), the adjusting means (11), (12) being provided in such a manner that its rotation will cause the separating means (1), (2) to be moved, because of which the holding height will be changed and adjusted and the adjusting means (11), (12) being able to maintain the adjusting means (1), (2) at the adjusted holding height. Moreover, the holding device (3,7,9,11), (4,8,9,12) will enable an adjustment in the warp-direction. With a similar device adjusting the holding height can be carried out in a very simple and accurate manner and whilst being adjusted the separating means (1), (2) will be unable to make any unwanted and dangerous movements.

13 Claims, 2 Drawing Sheets

DEVICE FOR SEPARATING WARP YARNS ON A FACE-TO-FACE WEAVING MACHINE

Figure 1:
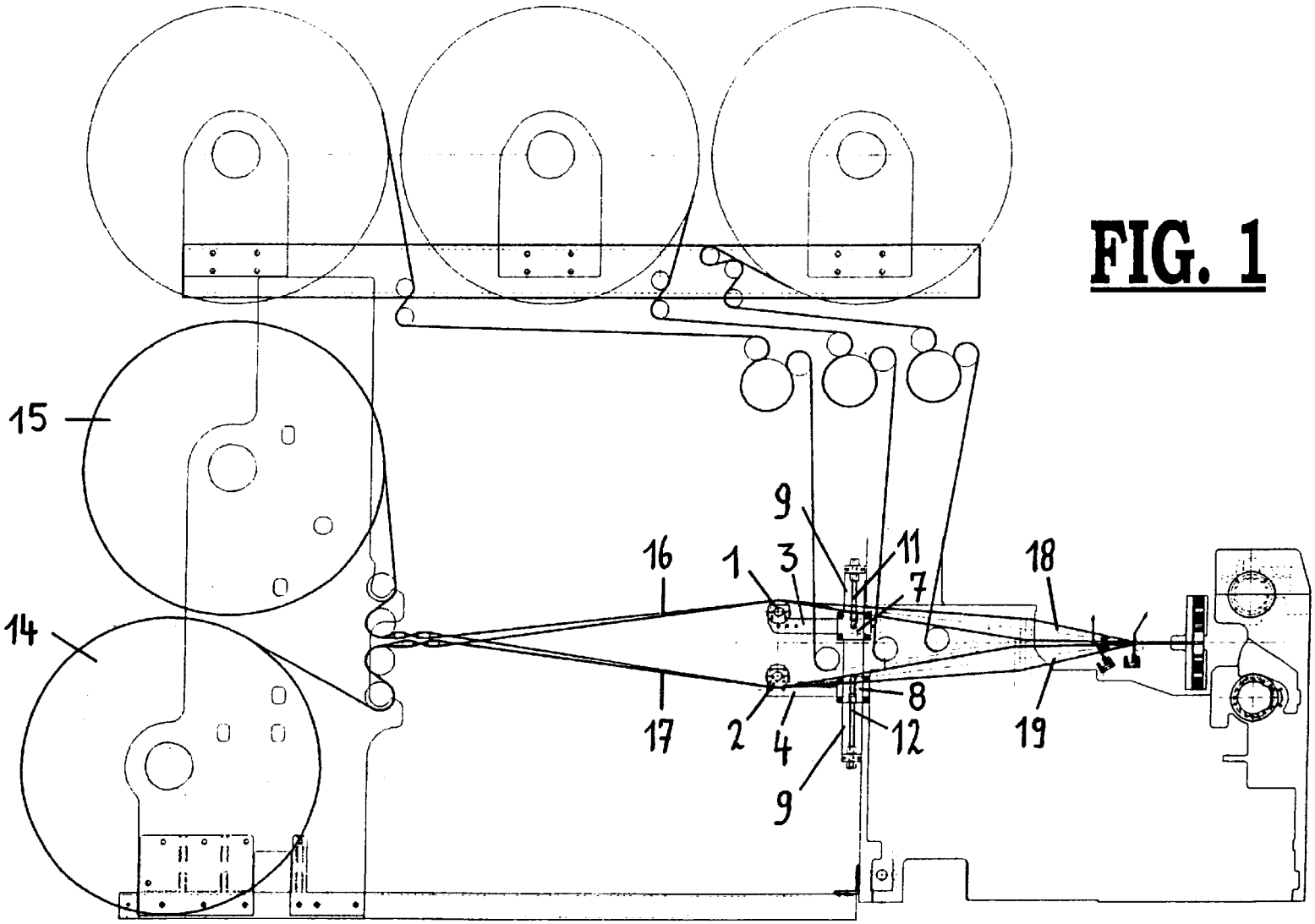

This invention relates to a device for separating warp yarns on a face-to-face weaving machine, comprising at least one separating means and a holding device provided to keep the separating device at a holding height and to adjust this holding height.

On a face-to-face weaving machine two backing fabrics are woven simultaneously above one another. For that purpose backing warp yarns (for instance tension warp yarns and binding warp yarns) are provided on the weaving machine. During consecutive weft insertion cycles an upper shed is formed between a number of backing warp yarns, and a lower shed is formed between a number of other backing warp yarns. This shed forming occurs by means of shed forming means that can bring the warp yarns into two different positions. Into these sheds each time a weft yarn is inserted during the consecutive cycles.

The ground warp yarn supply is provided on warp yarn beams, for instance a tension warp yarn beam and a binding warp yarn beam. From those beams the backing warp yarns are conducted to the weaving machine. Before the yarns reach the shed forming means they are separated into two layers situated above one another. An upper layer with the backing warp yarns, which are needed to weave the upper backing fabric and a lower layer with the backing warp yarns, which are needed to weave the lower backing fabric.

It is generally known to keep these two layers of backing warp yarns separated from one another by means of two yarn separating cylinders. These cylinders are situated above one another between the two yarn layers, the warp yarns of the upper layer running over the top of the upper yarn separating cylinder, and the warp yarns of the lower layer touching the lower side of the lower yarn separating cylinder. In this manner, the warp yarns of the two layers are kept separated from each other at a vertical distance and are kept well apart.

In order to prevent the backing warp yarns from becoming slack in one of their two positions, each yarn separating cylinder has to be installed exactly in the bisector plane of the respective shed. It is known to attach these yarn separating cylinders to the weaving machine by means of a holding device enabling the holding height to be adjusted and to be adjusted in the warp-direction.

In a known adjustable device to separate the yarns on a face-to-face weaving machine the separating cylinders are connected to respective holders, which extend horizontally in the warp-direction towards the yarn beams. These holders are provided with a number of holding bores separated from one another in the warp-direction. A vertical cylindrical bar, which is fixed to the frame of the weaving machine, extends through a holding bore of both holders. In this manner, the holders are provided on the bar in a slidable manner and they may be attached to this bar at a height as desired by means of a clamp joint. These clamp joints are fixed by means of a bolted joint. The position of the separating cylinders is adjustable in the warp-direction by using another holding bore.

However, this known device has a number of important disadvantages. When adjusting a new holding height of the separating cylinders, after loosening the clamp joint, the holder remains in its original position on the vertical cylindrical bar because of its self-clamping action. Only when driving a wedge into the clamp opening, the clamp joint opens all of a sudden and the separating cylinder will move downwards or upwards under the influence of its own weight and/or under the influence of a tractive force, exerted on the separating cylinder by the warp yarns. Because of this, the original adjustment will be totally lost. When adjusting a separating cylinder at a new holding height it is however desirable that the original holding height can be used as a reference. For that purpose, with this device, the original position should be marked or measured first before loosening the clamp joint. Than the new position can be compared with the original position either by referring to this marking, or by measuring once again the new position and by comparing the new measured value with the measured value of the original position. Therefore adjusting the separating cylinders is a complicated and time-consuming job and, moreover, it cannot be done with great precision.

Moreover, when loosening the clamp joint by driving in a wedge, there is always a risk that the separating cylinders start falling downwards or moving upwards under the influence of their own weight and/or under the influence of the tractive force exercised on the separating cylinders by the backing warp yarns. This movement of the separating cylinders can be dangerous, so that the person who carries out this job should be prepared for a temporarily unsafe situation.

The purpose of this invention is to provide a device to separate the warp yarns on a face-to-face weaving machine by means of which the above-mentioned disadvantages can be remedied and which therefore will enable the holding height to be adjusted in a simple and exact manner under safer conditions.

According to this invention this goal is achieved by providing a device to separate warp yarns on a face-to-face weaving machine, which has the characteristics mentioned in the first paragraph of this description and the holding device of which comprises a threaded adjusting means, whereas the adjusting means is provided in such a manner that its rotation causes the separating means to be moved, because of which the holding height is changed and whereas the adjusting means can maintain the separating means at the holding height adjusted.

With this device, the holding height of the separating means can be changed by rotating a threaded adjusting means. A similar adjusting is particularly simple and can be done with great precision. Because the adjusting means is also provided to hold the separating means at the adjusted height, during this adjusting operation, any unwanted and dangerous upward and downward movements of the separating means, under the influence of its weight and/or the tractive force of the warp yarns, are avoided. Therefore, with the device according to this invention, adjusting the holding height can be done in a far more exact and simple manner, and under safer conditions than with the known devices.

In a preferred embodiment of this invention the adjusting element is attached rotatably at a fixed height and this element is provided to move the separating element by means of its screw thread.

For instance, the adjusting element may be carried out as an adjusting element (for instance an adjusting spindle) attached at a fixed height with a threaded handle extending vertically, engaging in a bore of the separating element or of a part connected to it, so that the rotation of the adjusting spindle in the bore causes the adjusting means to be moved up or down (depending on the sense of rotation).

Preferably, the holding device is also provided to adjust the position of the separating element in the warp-direction.

The holding device can also be carried out with a movable intermediate part to which the separating means is connected, the position of the separating element being adjustable in the warp-direction with respect to the intermediate part and the adjusting means being provided to move the intermediate part in order to adjust the holding height. Thus a simple holding device is obtained where adjusting the height and adjusting in the warp-direction can occur on the same adjusting point.

In a particular embodiment the holding device comprises also a fixedly attached support, whereas the adjusting means makes a connection between the support on the one hand and the separating means, or a part connected to this separating means, on the other hand.

If the intermediate part is attached in a movable manner on a part of the support extending in a practically vertical direction a device is obtained with a holding height that can be adjusted in a very easy and accurate manner.

In a very advantageous embodiment of this invention reference marks, such as a graduation for instance, are provided on a part of the holding device to be fixedly attached to it, in order to determine or read the position of the intermediate part with respect to the support. With these reference marks (for instance dots, lines, numbers, letters) or graduation, the corresponding position of the intermediate part can be easily determined or read for the different holding heights. For instance, this position can be read very easily on a graduation with numbers. Because of this it will become very simple to adjust a holding height without measuring or without any other means, one or more other holding heights being used as a reference. If the distance between the reference marks has been chosen to be sufficiently small, this will also enable the holding height to be adjusted with far greater precision than with the other devices known at this moment.

Preferably the holding means comprises a support connected to the separating means which is connected to the said intermediate part in a manner slidable in the warp-direction. Because of this, adjusting in the warp-direction can be carried out in a more simple manner and with a greater number of different positions than with the known devices mentioned above.

It is further very advantageous and useful when reference marks, such as for instance a graduation, is provided on the holder in order to determine or to read the position of the holder with respect to the intermediate part. This also enables to determine or to read the corresponding position of the holder for different positions in the warp-direction. Because of this, adjusting in the warp-direction may be realized in a more accurate and simple manner. Also when adjusting in case one or more other positions in the warp-direction should be used as a reference, this becomes very easy without measuring or any other means.

Preferably, the holding device further comprises also clamping means to maintain the intermediate part in a position adjusted with respect to the support and to maintain the holder in a position adjusted with respect to the intermediate part. Preferably these clamping means are bolts provided in a same clamping block with cover.

In a very preferred embodiment of the invention the intermediate part is crossed by a part of the support extending in a practically vertical direction and by a part of the holder extending in the warp-direction. Preferably, the said clamping means are provided at the intersection of these two parts crossing the intermediate part.

Preferably, the device according to this invention is carried out with two separating means and for each separating means a holding device having one or more of the particular characteristics mentioned above. Because of this the holding height of each separating means can be adjusted in a simple and accurate manner and without any safety risks, so that each yarn layer can be conducted over the respective separating means to the weaving machine at the ideal height. Then both holding devices can best be carried out with respective adjusting means and intermediate parts means working together with a common support.

Of course, a face-to-face weaving machine provided with a device to separate the warp yarns according to this invention is also within the scope of this invention.

The characteristics, advantages and particulars of this invention are further clarified in the more detailed description of an embodiment following hereafter. The only purpose of this description is to clarify the invention by means of an example and may in no way be considered as a limitation of the scope of this patent application.

Figure 2:
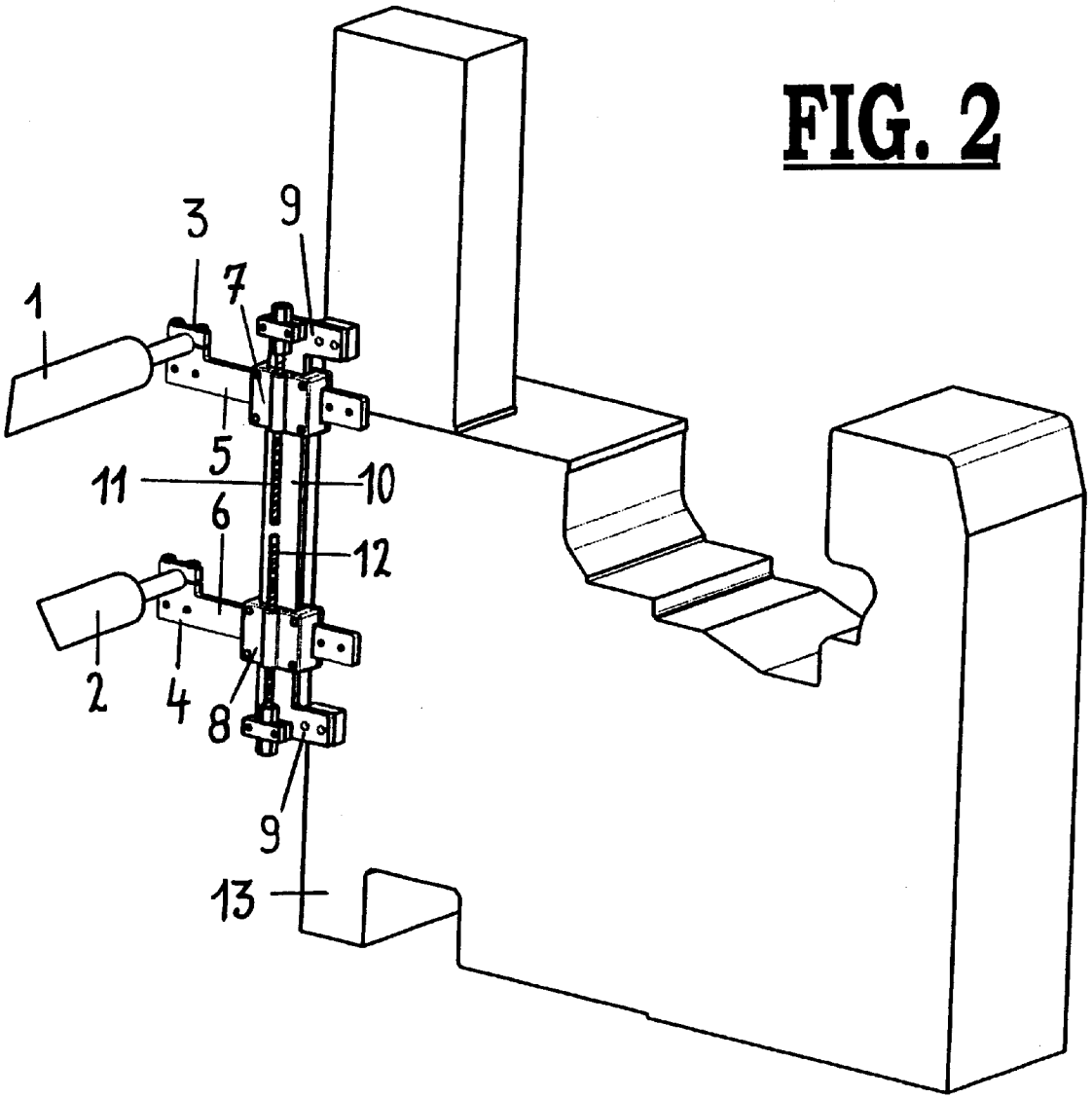

In this description reference is made by means of reference numbers to the attached drawings, of which FIG. 1 schematically represents a side view of a face-to-face weaving machine with a device with adjustable yarn separating cylinders according to this invention, and FIG. 2 represents a perspective view of a yarn separating device according to this invention attached to the frame of a weaving machine.

On a face-to-face weaving machine tension warp yarn and binding warp yarn is stored on warp yarn beams (14), (15) respectively. These backing warp yarns are conducted to the weaving machine in two layers (16), (17) situated above one another. The upper layer (16) contains the tension and binding warp yarns for weaving the upper backing fabric. The lower layer (17) contains the tension and binding warp yarns for weaving the lower backing fabric. By means of shed forming means an upper shed (18) is formed between the warp yarns of the upper layer (16) and a lower shed (19) is formed between the warp yarns of the lower layer (17). Into these sheds (18), (19) weft threads are inserted, so that together with the warp yarns of each layer (16), (17) they constitute a respective backing fabric.

On the weaving machine, two separating cylinders (1), (2) are provided above one another to separate the warp yarns of the upper layer (16) from the warp yarns of the lower layer (17), before these yarns reach the shed forming means. So an upper layer of warp yarns (16) is obtained, the yarns of which run over the top side of the upper separating cylinder (1) and a lower layer of warp yarns (17) is obtained, the yarns of which run over the bottom side of the lower separating cylinder (2). In order to be able to keep the yarns (16), (17) tight in each position in their respective shed, it is important that each yarn separating cylinder (1), (2) is accurately adjusted at a holding height coinciding with the bisector plane of a respective shed (18), (19). Further the position of the yarn separating cylinders (1), (2) should be adjustable in the warp-direction.

For that purpose an adjustable holding device is provided in the possible embodiment represented in the figures. This holding device comprises a holding bracket (9), which is attached to the main frame (13) of a face-to-face weaving machine. This holding bracket (9) has an elongated vertical central part piece (10) with an essentially rectangular cross-section and an upper and a lower transversely running end piece in which bores have been provided for means of attachment.

Two pushers (7), (8) with a vertical crossing opening and a crossing opening extending in the warp-direction are provided slidably on the vertical central piece (10). In this position the central piece (10) extends through the vertical opening. This opening has a rectangular form corresponding with the cross-section of the central piece (10). The pushers (7), (8) are slidable on the central piece (10) of the holding bracket (9) and, in a certain position, they can be moved upwards by means of a respective adjusting spindle (11), (12).

At a fixed height, the upper adjusting spindle (11) is attached rotatably to the upper extremity of the holding bracket (9) and has a handle extending vertically downwards, which is threaded. This handle extends through a vertical bore of the upper pusher (7). At a fixed height, the lower adjusting spindle (12), is rotatably attached to the lower extremity of the holding bracket (9) and has a handle, extending vertically downwards, which is threaded. The handle of the lower adjusting spindle (12) extends through a vertical bore of the lower pusher (8). By rotating their respective adjusting spindle, the upper (7) and the lower pusher (8), can be moved up and down by the action of the thread, sliding over the central piece (10) of the holding bracket (9). The position of the pushers (7), (8) can be read on a graduation (not represented in the figure), applied to the vertical bracket (9).

The separating cylinders (1), (2) provided above one another are connected to a respective holder (3), (4), which is provided with an elongated slat (5), (6) having a rectangular cross-section. In each pusher (7), (8) an opening of a rectangular form is also provided, crossing the pusher in the warp-direction. The latter slats (5), (6) slidably extend in the warp-direction, through the latter opening of a respective pusher (7), (8). On these slats (5), (6) of the separating cylinder holders (3), (4) a graduation (not represented in the figures) has been provided to read the horizontal adjustment.

At the intersection of the vertical central piece (10) of the holding bracket (9) and the slat (5), (6) extending in the warp-direction a clamping block with cover is provided to fix the adjusted position by tightening the clamping bolts (not represented in the figures).

With this device adjusting the separating cylinders (1), (2) is quite a bit simpler. The clamping bolts are loosened. The separating cylinders (1), (2) cannot fall or move upwards, because the adjusting spindles (11), (12) keep the pushers (7), (8) in their places. The vertical adjustment is obtained by rotating the adjusting spindles (11), (12) and the adjustment attained is read on the graduation. The adjustment in the warp-direction is carried out by sliding the slats (5), (6) in the pushers (7), (8) while the adjustment is read on the graduation. Finally the clamping bolts are tightened again. Adjusting can be carried out in a particularly accurate manner and gives no cause to temporarily unsafe situations.

What is claimed is:

1. Device for separating warp yarns (16), (17) on a face-to-face weaving machine (13), comprising a separating means (1), (2) and a holding device (3,7,9,11), (4,8,9,12) provided to maintain the separating means (1), (2) at a holding height and to adjust this holding height, characterized in that the holding device (3,7,9,11), (4,8,9,12), comprises a threaded adjusting means (11), (12), in that the adjusting means (11), (12) is provided in such a manner that its rotation causes the separating means (1), (2) to be moved, because of which the holding height is changed and in that the adjusting means (11), (12) can hold the separating means (1), (2) at an adjusted holding height.

2. Device for separating warp yarns (16), (17) according to claim 1, characterized in that the adjusting element (11), (12) is attached rotatably at a fixed height and is able to move the separating element (1), (2) by means of its screw thread.

3. Device for separating warp yarns (16), (17) on a face-to-face weaving machine, according to claim 1 or 2, characterized in that the holding device (3,7,9,11), (4,8,9,12) is also provided to adjust the position of the separating element (1), (2) in the warp-direction.

4. Device for separating warp yarns (16), (17) according to claim 3, characterized in that the holding device (3,7,9, 11), (4,8,9,12) comprises a movable intermediate part (7), (8), in that the separating means (1), (2) is connected to this intermediate part (7), (8), in that the position of the separating means (1), (2) is adjustable in the warp-direction with respect to the intermediate part (7), (8) and in that the adjusting means (11), (12) is provided to move the intermediate part (7), (8) in order to adjust the holding height.

5. Device for separating warp yarns (16), (17) according to any one of the preceding claims, characterized in that the holding device (3,7,9,11), (4,8,9,12) comprises a fixedly attached support (9) and in that the adjusting means (11), (12) connects the support (9) on the one hand and the separating means (1), (2) or a part (7), (8) connected to this separating means (1), (2) on the other hand.

6. Device for separating warp yarns (16), (17) according to the claims 4 and 5, characterized in that the intermediate part (7), (8) is slidably attached to a part (10) of the support (9) extending in a practically vertical direction.

7. Device for separating warp yarns (16), (17) according to claim 6, characterized in that reference marks are provided on a part (7), (8) of the holding device (3,7,9,11), (4,8,9,12), to be attached fixedly, such as for instance a graduation to determine or to read the position of the intermediate part (7), (8) with respect to the support (9).

8. Device for separating warp yarns (16), (17) according to any one of the claims 3 up to and including 7, characterized in that the holding device (3,7,9,11), (4,8,9,12) comprises a holder (3), (4) connected to the separating means (1), (2) and is connected slidably in the warp-direction to the said intermediate part (7), (8).

9. Device for separating warp yarns (16), (17) according to claim 8, characterized in that reference marks, such as for instance a graduation, are provided on the holder (3), (4), in order to determine or to read the position of the holder (3), (4) with respect to the intermediate part (7), (8).

10. Device for separating warp yarns (16), (17) according to any one of the preceding claims, characterized in that the holding device (3,7,9,11), (4,8,9,12) comprises clamping means to maintain the intermediate part (7), (8) in an adjusted position with respect to the support (9) and to maintain the holder (3), (4) in an adjusted position with respect to the intermediate part (7), (8).

11. Device for separating warp yarns (16), (17) according to the claims 4, 5 and 8, characterized in that the intermediate part (7), (8) is crossed by a part (10) of the support (9) extending in a practically vertical direction and by a part (5), (6) of the holder (3), (4) extending in the warp-direction.

12. Device for separating warp yarns (16), (17) on a face-to-face weaving machine, according to any one of the preceding claims, characterized in that the device comprises two separating means (1), (2) and a holding device (3,7,9, 11), (4,8,9,12) for each separating means (1), (2).

13. A face-to-face weaving machine provided with a device to separate the warp yarns (16), (17), according to any one of the preceding claims.

* * * * *